US005219405A

United States Patent [19]

Weiss

[11] Patent Number: 5,219,405

[45] Date of Patent: Jun. 15, 1993

[54] CONTINUOUSLY OPERATING ROTATIONAL BOTTLE FILLING INSTALLATION

[75] Inventor: Wilhelm Weiss, Hainsaker, Fed. Rep. of Germany

[73] Assignee: Krones AG Hermann Kronseder Maschinenfabrik, Neutraubling, Fed. Rep. of Germany

[21] Appl. No.: 816,174

[22] Filed: Jan. 2, 1992

Related U.S. Application Data

[63] Continuation of Ser. No. 466,317, May 4, 1990, abandoned.

[30] Foreign Application Priority Data

Dec. 16, 1987 [DE] Fed. Rep. of Germany ... 8716584[U]

[51] Int. Cl.[5] ..... B65B 3/04

[52] U.S. Cl. ..... 141/149; 141/150; 141/165; 141/372

[58] Field of Search ..... 141/138, 140–150, 141/156, 157, 159, 165, 161, 168, 175, 181, 184, 191, 254, 275, 276, 369–372, 374–376, 378; 198/476.1, 485.1

[56] References Cited

U.S. PATENT DOCUMENTS

| | | | |
|---|---|---|---|
| 582,285 | 5/1897 | Henes et al. | 141/372 X |
| 713,160 | 11/1902 | Schneider et al. | 141/372 |
| 717,033 | 12/1902 | Schneider et al. | 141/372 |
| 933,518 | 9/1909 | Zeller | 141/370 |
| 1,521,928 | 1/1925 | Campbell | 141/372 |
| 2,172,012 | 9/1939 | Luhdorff | 141/147 X |
| 2,634,035 | 4/1953 | Davis | 141/165 |
| 3,175,702 | 3/1965 | Banyas | 198/476.1 X |
| 4,456,040 | 6/1984 | Bacroix et al. | 141/150 |
| 4,616,684 | 10/1986 | Tincati | 141/372 X |
| 4,721,138 | 1/1988 | Simonazzi | 141/150 |
| 4,798,234 | 1/1989 | Dugan | 141/165 |

FOREIGN PATENT DOCUMENTS

| | | | |
|---|---|---|---|
| 0362005 | 10/1922 | Fed. Rep. of Germany | 141/372 |
| 0482845 | 4/1938 | United Kingdom | 141/372 |
| 2204571 | 11/1988 | United Kingdom | 141/369 |

*Primary Examiner*—Henry J. Recla

*Attorney, Agent, or Firm*—Fuller, Ryan, Hohenfeldt & Kees

[57] ABSTRACT

A device for filling PET bottles employs a cam driven vertically movable carriage mounted on the outside of the liquid storage tank adjacent each filler valve inside of the tank. A bracket mounted to the lower end of each carriage has a flat plate extending horizontally under a filler valve. A bottle gripper, having an open side slot for engaging under the collar near the mouth of a PET bottle, is suspended on two bolts which extend slidably through the flat plate. Normally uncompressed springs are interposed between the heads of the bolts and the top of the plate to hold the gripper against the bottom of the flat plate. A cam lifts the carriage after the gripper engages a bottle under its collar to initiate a seal between the bottle mouth and filler valve and as the carriage continues upward by a small amount for latching to the tank. The springs are compressed and a gap forms between the flat plate and the gripper. The plate compresses the spring which generates the force to increase the sealing force. The carriage latching is frictional and is not maintained to suspend a bottle unless the carriage is loaded gravitationally by the weight of a bottle.

22 Claims, 3 Drawing Sheets

CONTINUOUSLY OPERATING ROTATIONAL BOTTLE FILLING INSTALLATION

RELATED CASE

This is a continuation of Ser. No. 07/466,317, filed May 4, 1990 now abandoned.

BACKGROUND OF THE INVENTION

The invention relates to a continuously operating rotational bottle filling device.

So called PET bottles (polyethyleneterephthalate), which have relatively thick-walled collars near their openings but have walls and bottoms that are thin, are being used to an ever increasing degree to contain beverages. When these bottles are put in a filling machine having support surfaces that raise and lower, it often happens that excessive axial pressure occurs when the bottle is applied against the filling unit, and this pressure is not withstood by the walls of the bottles.

Bottle filling devices have therefore been developed which, instead of having supporting surfaces for the bottoms of the bottles, use a gripping device for lifting the bottle by stiff collars that surround the mouth of the bottle in order to avoid axial overload on the body of the bottles. DE-OS 35 06 250, (U.S. Pat. No. 4,616,684), for example, discloses a bottle filling installation with such gripping devices which are respectively fastened to a vertically movable carriage that mounts to the rotating liquid storage tank. The track for the carriage is then supported externally of the valve body of the filling unit and is rigidly attached at its lower end to the U-shaped gripping device used for engaging the bottle collar. In order to bring about the application force by which the opening of the bottle is pressed against the seal of the filling unit so as to ensure filling that is problem-free when the bottle is in the filling position, this known installation features a pressure spring engaged between the fixed valve body and the movable carriage, said pressure spring acting upwards on the carriage. The carriages have rollers that are respectively raised or lowered at the intake and outlet of the filling installation by a fixed control cam. Since the pressure spring, which is under a minimum of tension when it is in the upper filling position, must nevertheless provide the required sealing force at the bottle mouth, the spring force increases greatly when the bottles are lowered, so that considerable spring force must be absorbed by the control cam or the carriage. This leads to signs of wear, particularly at the control cams. If, on the other hand, the pressure spring is replaced by a work cylinder in this known bottle filling installation, there is a danger of contaminating the filling units and the bottles by the escape of hydraulic oil or lubricating oil in the compressed air, so this solution is thus also not satisfactory.

From EP-OS 222 208 (U.S. Pat. No. 4,721,138) another bottle filling device of the type mentioned in the introduction is known, by which excessive loads on the control paths are avoided. For this purpose, a locking device is provided which locks the carriage into the upper filling position while the required application force for the bottle mouth is brought about by the fact that the filling unit with its sealing element rests on the liquid-containing tank and is vertically movable by means of a pressure spring. With this known bottle filling device the filling unit is raised against the pressure of the spring under tension during the last phase of the bottle-lifting motion, until the locking device locks the carriage. With this type of construction, therefore, a spring force results which only generates the required sealing force. But since the sealing element of the filling unit is arranged so as to be vertically movable under the liquid-containing tank, the clearance between the sealing element onto which the bottle opening is applied during filling and the seat of the liquid valve is relatively large, which, for reasons relating to filling technology, is a disadvantage. Additionally, the hollow spaces and the annular clearance within the sliding sleeve that bears the sealing element are difficult to clean.

The invention at hand is thus given the task of further improving a rotational bottle filling device of the type being considered, such that it completely satisfies the requirements relating to filling technology, and such that its mechanical construction is simple and sturdy.

SUMMARY OF THE INVENTION

According to the invention, the gripping device for the bottle collar is arranged so as to be movable in the vertical direction by a carriage and the gripping device is elastically supported on it by means of the springs which provide the required application force for the bottle neck, while the filling unit is fixed against vertical movement at the underside of the filling tank, so that the seal of the filling unit is located directly under the seat of the liquid valve in the filling unit. In this way, the path between the bottle mouth and the seat of the liquid valve is considerably decreased and cleaning problems relating to the filling unit are to a large degree avoided Since, with the bottle filling device according to the invention, the maximally occurring spring force also corresponds to the desired bottle mouth sealing force, the control path, carriage and filling unit are subjected only to slight mechanical loads, and wear is correspondingly slight.

Two bolts are fastened onto the gripping device 5, guided in a flat plate of the carriage so as to be vertically movable and respectively pressed toward the top by a pressure spring which is arranged between the flat plate 7 and the upper end of the bolts.

According to the invention it is suggested that the locking device features a blind-end bore, advantageously constructed in the wall of the liquid-containing tank, into which a sliding bolt engages when it reaches the upper filling position, said bolt preferably being integrated in the axis of the carriage roller. The blind-end bore is constructed at a height such that during the final phase of the lifting movement of the carriage the pressure springs are stressed. This means that first the bottle mouth runs up against the seal of the filling unit that is arranged in a vertically fixed manner, whereby the gripping device is brought to a halt. But the carriage keeps moving for a short upward distance, until the bolt engages in the blind-end bore, whereby the pressure springs that are arranged between the carriage and the gripping device become stressed to a predetermined degree.

The bolt is advantageously acted upon by a pressure spring in the direction of the unlocking position, in which a head section protrudes over the front surface of the roller that faces away from the liquid tank. The carriage lock is released when the head section of the bolt, upon reaching the upper filling position, runs up against a fixed control cam; that is, one which does not rotate with the bottle filling device, so that the bolt engages the blind-end bore.

It is highly advantageous for the bolt to be held in the lock position by means of frictional forces acting between its seating area and the respective wall of the blind-end bore when spring forces come into effect between the carriage and the gripping device by the placement of the bottle opening on the seal of the filling unit. This means that the carriage only remains frictionally locked in the upper filling position when its gripping device contains the weight of a bottle. If, on the other hand, no bottle is present, then, as a consequence of absent spring forces between the carriage and the gripper device, the frictional forces acting on the bolt are so low that it is moved back to the release position by the pressure spring acting on it; that is, it exits the blind-end bore. The consequence of this is that the carriage with the gripping device is again released and lowered. Thus, the spring arranged between the carriage and the gripping device not only produces the required application force for the bottle mouth, but also simultaneously serves as a control device for unlocking the respective carriage for which there is no bottle. The necessity of having an additional control cam or a suitable contact element for automatically lowering a gripping device without a bottle is eliminated. The automatic lowering of the carriage rotating without a bottle avoids the need for supporting forces, and decreases wear.

The bottle filling device according to the invention has an intake control path on which the carriages are raised into the filling position, and an outlet control path on which the carriages are lowered in a controlled manner by means of rollers. To ensure a control-free entrance of the bolt into the blind-end bore and an unimpeded exit from the blind-end bore, the intake control path and the outlet control path should be designed with a slight excess lift which only needs to be several tenths of a millimeter, in order to minimize or eliminate the frictional forces in the blind-end bore.

As has been stated above, the carriages which do not possess bottles when reaching the top filling position are again lowered in a controlled manner, and a corresponding lowering path is necessarily connected to the intake control path. The lowered carriages are raised again on an elevating path installed before the outlet path on the outlet star wheel of the installation, in order to then be lowered again in a controlled manner with the remaining carriages.

As an alternative to this, the bottle filling installation according to the invention can also be designed such that the carriages or gripping devices that are not supplied with bottles are not lowered automatically, but rather remain in the elevated position until reaching the outlet control path. With this type of embodiment the lowering path of the inlet control path and the elevating path of the outlet control path are eliminated.

According to the invention it is finally recommended that an actuation element of a vacuum valve which is used to suction the bottles before filling is attached in such a position on the wall of the liquid-containing tank that the valve is opened by a carriage that has arrived in the filling position. If a carriage reaches the upper filling position in a system of this type without a bottle and, as a result of this, is automatically lowered again, then the vacuum valve is again immediately closed, so that an undesirable increase in pressure in the vacuum system is avoided Other specific characteristics of the invention become evident in the following description of a preferred embodiment of the invention, as well as on the basis of the drawing.

DESCRIPTION OF A PREFERRED EMBODIMENT

Figure 1:
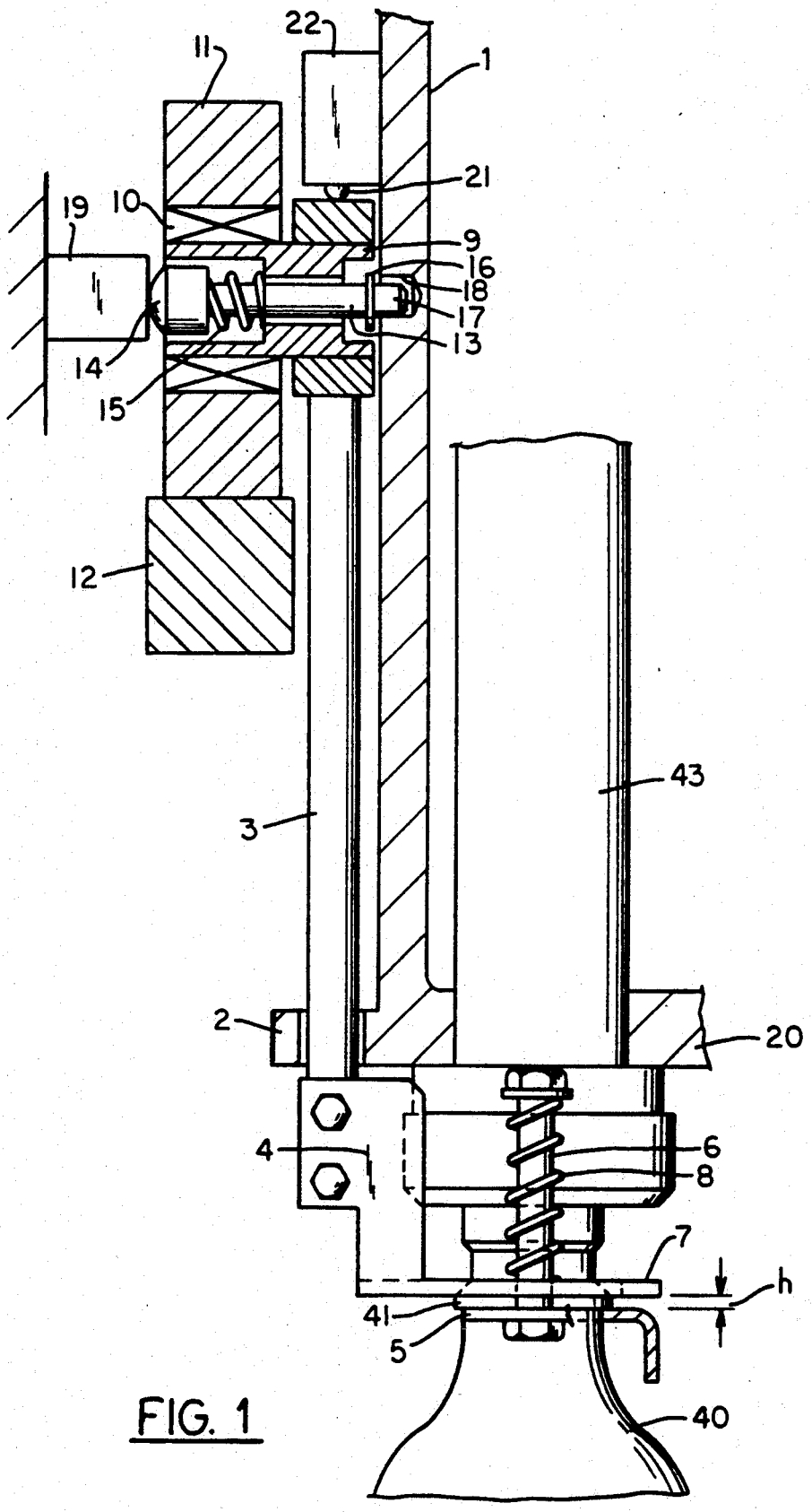
FIG. 1 a partially sectioned longitudinal section through an embodiment of the invention when it is in its upper bottle filling position.

FIG. 1 depicts a wall 1 of the liquid-containing tank of a continuously operating rotational bottle filling installation which is provided with a carriage track 2 for a carriage 3 On the lower end of the carriage 3 a bracket 4 is fastened, on which a gripping device 5 for bottle collars is resiliently supported.

Moreover, the gripping device 5 is provided with two bolts 6 which have clearance between them, and which penetrate bore holes in a plate 7 of the bracket 4 in a loosely-fitting manner. A compression spring 8 is arranged between the upper end of each bolt 6 and the plate 7, pressing the bolts 6 with the gripping device 5 upward.

Figure 4:
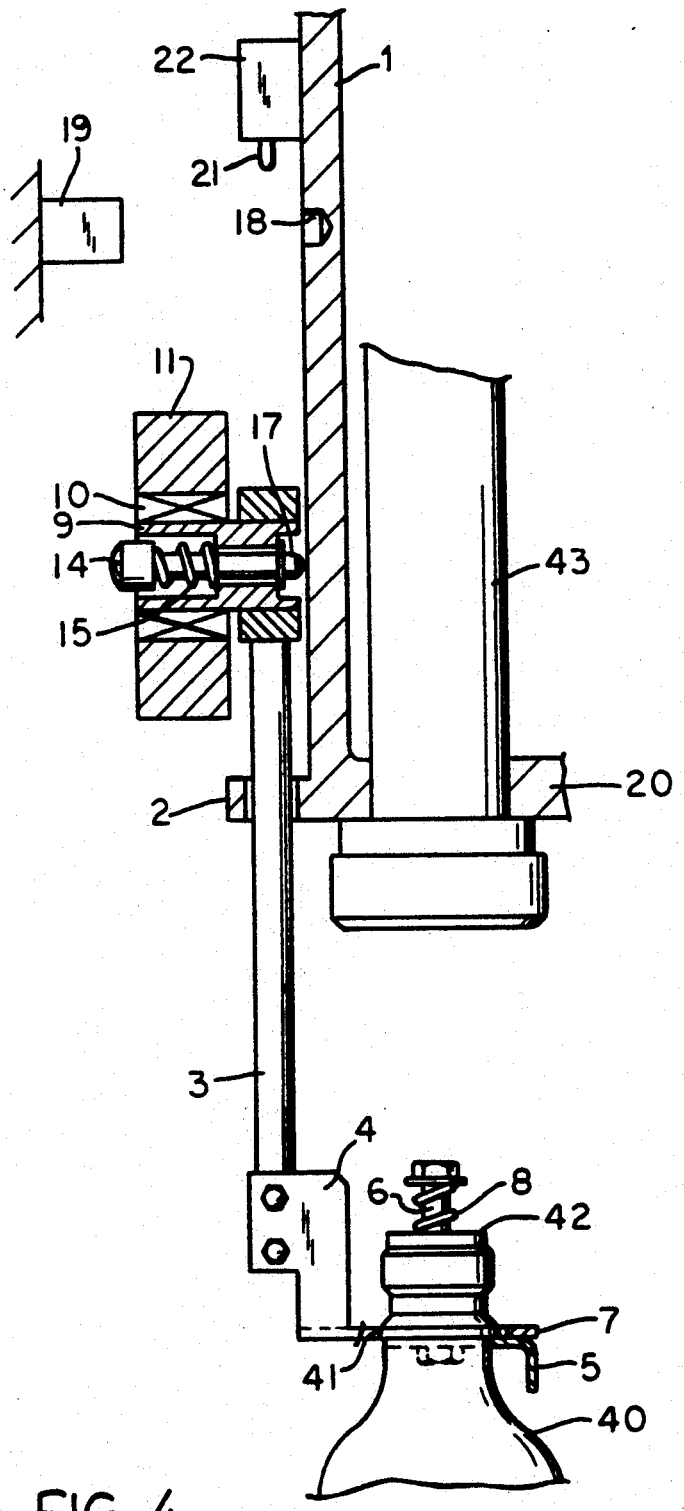
FIG. 4 is similar to FIG. 1 structurally except that it shows the invention when it has just gripped a bottle by its collar in preparation for lifting the bottle to its filling position.

In FIG. 4 the bottle gripping device 5 has gripped the bottle 40 under its annular collar 41 so the carriage 3 can lift the bottle in response to rolling onto the stationary cam 12 shown in FIG. 1. Note in FIG. 4 that gripping device 5 has been forced into direct contact with plate 7 because of spring 8 pushing bolt 6 and, hence, the gripping device upward.

An axle 9 is fastened in the upper end section of carriage 3, rotatably supporting a roller 11 by means of a roller bearing. The roller 11 is guided by a control cam 12 in the area of the bottle input intake and the bottle output of the bottle filling installation, whereby the carriage 3 with the gripping device 5 is moved upward and downward in a controlled manner.

A bolt 13 which has a head section 14 is integrated into the axle 9, said head section being acted upon by a pressure spring 15 such that the bolt 13 projects from the front face of the roller 11, facing away from the wall 1 of the liquid containing tank. A ring-shaped projection 16 that is formed on the bolt 13 hereby limits the advance of the bolt 13. The bolt 13 can enter into a blind-end bore 18 in the wall 1 with its end section 17 that faces the wall 1 of the liquid-containing tank when the carriage 3 has reached the upper bottle filling position as it has done in FIG. 1.

For this purpose, a sequence switch cam 19 is arranged in a fixed manner at the position of the control cam 12 where the carriage 3 reaches the upper filling position, whereby the head section 14 of the bolt 13 runs up against the sequence switch cam 19 such that the bolt 13 enters into the blind-end bore 18 with its end section, against the force of the spring 15 that is thereby being compressed.

But before the carriage 3 reaches the upper filling position, the open mouth 42 of a bottle 40 held by the gripping device 5 is placed against the seal of a filling unit 43 which is arranged at the corresponding position under the floor 20 of the liquid-containing tank. As a result of this vertically fixed arrangement, the seal, not visible, in the filling unit 43 can be a minimal distance from the liquid valve, not visible, in the filling unit Placement of the bottle mouth onto the seal of the filling unit 43 results in the gripping device 5 immediately coming to rest, while the carriage 3 continues a slight motion upward to the locking position in which bolt 13 registers in the blind-end bore or recess 18 as illustrated in FIG. 1. As a result of this additional lifting distance the pressure spring 8 becomes stressed, so &:hat the bottle mouth is pressed tightly against the seal of the filling unit 43.

The force resulting from spring 8 furthermore causes frictional forces in the blind-end bore 18 between the seat area of the end section 17 of the bolt 13 and the adjacent area of the blind-end bore 18, said forces being great enough that the bolt, despite the acting force of spring 15, is held in the locked position. But if the gripping device 5 contains no bottle, then the pressure springs 8 are not stressed, and thus no frictional forces are evoked that can hold the bolt 13 in the blind-end bore 18. In this case the bolt 13 is again moved into the release position after passing the sequence switch cam 19 as a result of the force of spring 15, so that the carriage 3 can lower.

In the upper filling position the carriage 3 activates an actuation element 21 of a vacuum valve 22, whereby the respective bottle is evacuated of air. If, however, no bottle is provided and the carriage lowers, then the vacuum valve 22 is immediately closed again.

Figure 2:
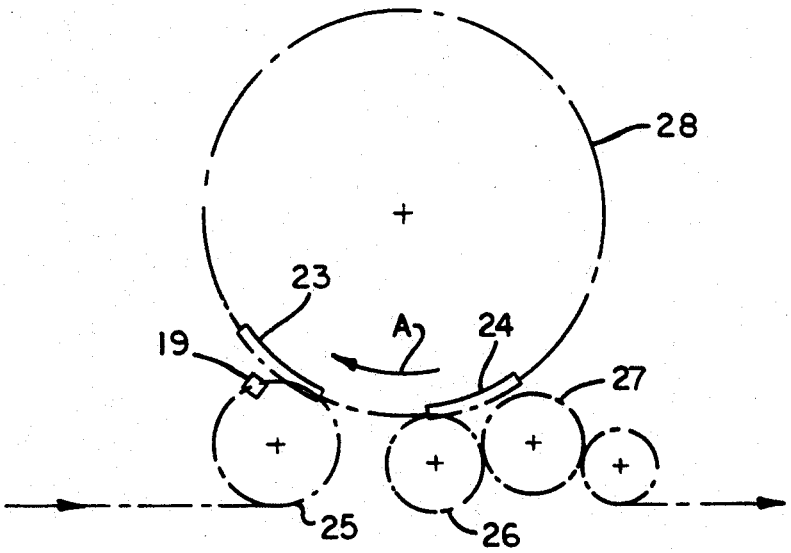
FIG. 2 a schematic drawing clarifying the intake control path and the outlet control path.

FIG. 2 illustrates the position of the intake control cam curve 23 and the outlet control cam curve 24, which are located near an intake star-wheel 25 or an intermediate star-wheel 26 The so-called sealing sector 27 connects to the intermediate star-wheel 26. The filler sector 28 turns in the direction of arrow A in FIG. 2, whereby the carriage 3 is moved upward on the intake control curve 23 until it is locked in its highest position, the filling position, by the fixed sequence switch cam 19.

Figure 3:
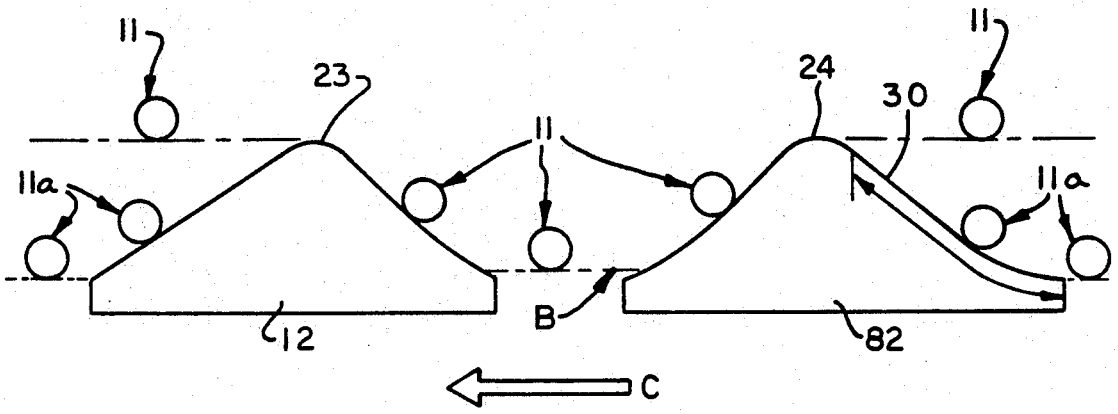
FIG. 3 a schematic representation of the control paths.

FIG. 3 illustrates a schematic representation of the intake control curve 23 and the outlet control curve 24. From a lower end position, which is indicated by arrow B, all rollers 11 are guided to the intake control curve 23 in the operating direction C, up to the filling position While the rollers 11 of the carriages 3 provided with bottles are locked in the upper position, the rollers **11*a* of the carriages without bottles are lowered in a controlled manner on a lowering path. These rollers 11*a* are finally raised again on an elevated path 30 and, together with the remaining rollers on the outlet control curve (24)**, are lowered again.

I claim:

1. Apparatus for filling bottles which have an annular collar near their mouths, the apparatus comprising:

a rotatable tank for containing liquid to be admitted to the bottles, the tank having a bottom, a bottle filling unit fixedly mounted in the tank for being engaged in sealing relationship by the mouth of a bottle when the bottle is lifted to be filled, a carriage arranged adjacent the filling unit outside of the tank and means for raising and lowering the carriage, a gripping member constructed for engaging a bottle below said collar to provide for lifting the bottle, and, means for mounting said gripping member resiliently to said carriage including spring means for biasing said gripping member in a direction upwardly of said carriage such that after said carriage is raised sufficiently for the mouth of the bottle to engage said filling unit, said carriage can continue to move upwardly in opposition to the force of the spring by an additional small amount to develop a predetermined sealing force between the mouth of the bottle and the filling unit.

2. The apparatus according to claim 1 wherein said means for mounting said gripping member comprises:

a bracket member mounted to said carriage;

two bolts extending vertically and freely through said bracket member, the lower ends of said bolts supporting said bottle gripping member beneath said bracket member, the upper ends of said bolts having stop means thereon, said spring means being interposed between the stop means and the bracket member for urging said bottle gripping member upwardly against the bracket member.

3. The apparatus according to any one of claims 1 or 2 including locking means for locking said carriage in an upper limit position relative to said tank after the mouth of a bottle engages said seal, comprising:

an axle member fixed in said carriage and a roller mounted for rotating on said axle member, said axle member having a bore substantially coaxial with the rotational axis of the roller, a socket arranged along said tank, a sliding bolt disposed in said bore coaxially with the roller, said bolt having a first end adapted for entering said socket and seating on the bottom thereof to support said carriage at a predetermined level when said carriage moves said additional amount, said sliding bolt also having a second end, biasing spring means operative to urge said sliding bolt in a direction which opposes entry of said first end into said socket, and means operative to apply a force to said second end of the sliding bolt when said carriage is in the last part of its lifting movement, said force overcoming the force of said biasing spring means such that said first end of said sliding bolt enters the socket when said end aligns with the socket.

4. The apparatus according to claim 3 wherein said means operative to apply a force to said second end of said sliding bolt comprises a fixed cam which is reached by said second end of the sliding bolt when said carriage attains a position resulting from rotation of the tank in which filling of the bottle occurs.

5. The apparatus according to claim 3 wherein said sliding bolt is retained in said socket by frictional force developed between said first end and where said first end seats in the socket under the influence of said spring means acting on said gripping member when the mouth of the bottle is sealed to said filling unit, and if no bottle mouth is engaged with said in filling unit insufficient frictional force is developed to retain said first end of the sliding bolt in the socket.

6. The apparatus according to claim 3 including an intake control cam for raising the carriage for filling the bottle and an outlet control cam for lowering the carriage circumferentially spaced from each other around said rotatable tank, said intake control cam being constructed such that when said roller on the carriage runs onto the intake control cam to raise the carriage, the sliding bolt is raised sufficiently clear of seating in the socket to assure that the first end of the sliding bolt can enter the socket without interference and without cancelling the force of said biasing spring.

7. The apparatus according to claim 6 wherein said outlet control cam for lowering the carriage is constructed such that when the roller on the carriage runs onto this cam, the carriage is lifted by a small amount sufficient to unseat the first end of the sliding bolt to assure that said first end slides out of the socket under the influence of said biasing spring to release the carriage so said roller can run on said outlet control cam to lower the carriage.

8. Apparatus for handling bottles which have an annular collar proximate to the mouth of the bottle in a machine for filling bottles with liquid, comprising:

a rotatable tank having a bottom, an array of bottle filling units arranged fixedly in the tank for conducting liquid from the tank to the bottle when the bottle is placed in sealing relation to the filling unit, carriage means mounted to said tank proximate to the respective associated filling units for being moved between a lower position and a predetermined upper locking position, a bottle gripping member adapted for engaging a bottle at its collar when the carriage means is in the lower position, spring means for producing a force biasing said gripping member upwardly toward said carriage means, locking means operative to lock said carriage means against movement relative to the associated filling unit when said carriage means reaches said upper locking position, means for moving the carriage means and the gripper member upwardly from a lower bottle engaging position until said carriage means almost reaches said locking position to cause the mouth of the bottle to enter into sealing relation with the filling unit and a continuing upward movement of said carriage means to locking position causing said bottle gripping member to separate from said carriage means and to further increase the force developed by the spring means in correspondence with the amount by which the gripping means separates from the carriage means.

9. The apparatus according to claim 8 wherein said filling units are arranged inside of the tank and each has a part which extends downwardly from the bottom of the tank, said part having a sealing element in it for being engaged by the mouth of a bottle to prepare the bottle for filling.

10. The apparatus according to any one of claims 8 or 9 including:

a bracket member extending horizontally from said carriage means and included in said support means for supporting said bottle gripping member on the carriage means, said bottle gripping member being constructed for engaging the bottle under its collar, two laterally spaced apart bolt means extending vertically and slidably through said bracket member and said bottle gripping member, said bolt means having a lower end portion on which said gripping member is supported and an upper end portion on which there is a radially extending stop element, and said spring means are constituted by compression springs interposed between said stop elements, respectively, and said bracket member for biasing said bottle gripping member to the bracket member.

11. The apparatus according to claim 8 wherein said locking means comprises:

a shaft member mounted to said carriage means and having a substantially horizontal bore, the axis of the bore being directed toward said tank, a sliding bolt slidable in said bore toward and away from said tank and a spring in said bore urging the sliding bolt in a direction away from the tank, said tank containing a socket into which said sliding bolt is inserted when said carriage completes said continuing upward movement coincidentally with said carriage reaching said upper position wherein the force of said spring applied to said gripping member is maximum.

12. The apparatus according to claim 11 wherein said shaft has a cam follower roller journaled for rotating on it about the axis of the bore containing the sliding bolt, said sliding bolt having one inside end presented toward said tank and an opposite outside end extending to the outside of the bore, a stationary cam having a profile onto which said roller runs as said tank and the carriage means thereon rotate to thereby raise said carriage means, and another stationary cam onto which said outside end of said sliding bolt runs for forcing said sliding bolt toward the tank to insert said inside end in the socket in the tank coincidentally with said carriage means being raised to said upper position.

13. The apparatus according to claim 12 wherein said carriage means and bottle thereon remain suspended from the gripping means after said carriage means passes the stationary cam which raises the carriage means and inserts the sliding bolt element into said socket.

14. The apparatus according to claim 12 including a stationary outfeed cam onto which said roller runs at a bottle outfeed position, the configuration of the last named cam being such as to lift the carriage means by a small amount so as to relieve the frictional force sufficiently for the sliding bolt to withdraw from the socket under the influence of said spring means to allow the carriage means to be lowered.

15. The device according to claim 14 wherein as said tank rotates, rollers of the successive carriage means run onto said outfeed cam to effect lowering of the carriage means.

16. The apparatus according to claim 12 wherein the cam on which the roller runs is configured such that the carriage means is lifted by a small amount in excess of the amount necessary for said bolt element to align with the bore for minimizing the frictional force between the bolt element and bore as said bolt element is biased into the bore.

17. The apparatus according to any one of claims 11 or 12 wherein said sliding bolt element is held in said socket by friction between the sliding said bore acting to bias said sliding bolt out of said bore is selected to be forceful enough to withdraw the sliding bolt from the socket when no bottle is supported from the carriage means and not so great as to overcome the frictional force produced by the weight of the carriage means and a bottle having a predetermined weight.

18. Apparatus for handling bottles in association with a bottle filling machine, the bottles each having a collar axially spaced from its mouth, comprising:

a continuously rotatable tank having a peripheral wall and bottom wall for containing the liquid which is to be admitted to the bottles, a plurality of carriages each operable to raise an individual bottle by its collar to an upper position for filling the bottle and to lower the bottle when it is filled, said carriages being mounted to the tank for reciprocating vertically relative to the tank and arranged in circumferentially spaced apart relationship around the tank adjacent respective filler units which are mounted fixedly to the tank, locking means for locking said carriages, respectively, in said upper position, a support member extending from each carriage at a level below said bottom of the tank for moving up and down with the carriage, a bottle gripping member arranged below said support member for gripping the bottle by its collar and spring means arranged for stressing said gripping member toward said support member such that when the carriage rises to near its said upper position the mouth of the bottle is stopped in sealing engagement with said filler unit and further rising of said carriage and support member thereon relative to the bottle gripping member causing an increase in the stress of the spring means and an increase in the sealing force between the filler unit and bottle mouth until the carriage locks in said upper position.

19. Apparatus for handling bottles in association with a continuously rotating bottle filling machine, which bottles have a collar axially spaced from its mouth, comprising:

a rotationally driven tank having a peripheral wall and bottom wall for containing the liquid which is to be admitted to the bottles and a plurality of bottle filler units arranged around the tank, a plurality of carriages operable to raise bottles to an upper position for filling and to lower bottles when they are filled, said carriages being mounted to the tank for reciprocating vertically relative to the tank and arranged in on the tank adjacent respective filler units which are mounted to the tank, locking means for locking said carriages, respectively, in said uppermost position, a support member extending from each carriage at a level below said bottom of the tank for moving up and down with the carriage, bottle gripping means for gripping a bottle under the collar thereof to lift the bottle and mounting means for mounting said gripping means to said support element resiliently for permitting said gripping means to move a small amount relative to said support member, said mounting means including parallel laterally spaced apart bolts passing freely through said support member and having axes directed vertically, said bolts having upper and lower ends and said gripping means being attached to said lower ends of the said upper end of the bolts and said support member for said spring means to urge said gripping means upwardly toward said support member.

20. The apparatus according to claim 19 wherein:

said locking means comprises a bolt on the carriage mounted for sliding transversely of the direction in which said carriage is movable up and down, said tank providing a bore adjacent each carriage coaxial with said bolt, said bolt being receivable in said bore for holding the carriage in said upper position when a bottle is raised to a filler unit for being filled, a roller journaled for rotation on each carriage about an axis coincident with the axis of the bolt, a control cam onto which the rollers run as a result of said tank rotating, said control cam being configured to cause said carriages to rise when bottles arrive where they are gripped by said gripping means until the bolt on the carriage is caused to enter said bore to lock said carriage in its upper position for filling a bottle, said locking occurring only if a bottle is in the gripping means while at the same time said spring means become stressed, a spring member which is arranged on the carriage for urging said bolt to withdrawn from said bore, and a fixed cam positioned for causing said bolt to enter said bore if the carriage is in its upper position when said bolt arrives at said fixed cam.

21. The apparatus according to claim 20 wherein if a bottle is present for being gripped and is being pressed against a filler unit, said resulting stress on said spring means causes sufficient friction between said transversely sliding bolt and said bore for said carriage to remain suspended with said bottle thereon so the bottle can fill.

22. The apparatus according to claim 20 wherein said control cam is designed to raise said carriage sufficiently for said transversely sliding bolt to enter and exit said bores reliably without initial frictional drag.

* * * * *

UNITED STATES PATENT AND TRADEMARK OFFICE

CERTIFICATE OF CORRECTION

PATENT NO. : 5,219,405

DATED : June 15, 1993

INVENTOR(S) : Wilhelm Weiss

It is certified that error appears in the above-identified patent and that said Letters Patent is hereby corrected as shown below:

Column 10, Claim 19, Line 15:

After "the" and before "said" insert ---bolts and spring means, respectively, being interposed between---.

Column 8, Claim 17, Line 3:

After "sliding" insert ---bolt and socket and the force of the spring means in---.

Signed and Sealed this

Nineteenth Day of April, 1994

*Attest:*

*Attesting Officer*

BRUCE LEHMAN

*Commissioner of Patents and Trademarks*